US007287301B2

(12) United States Patent
Marshall et al.

(10) Patent No.: US 7,287,301 B2
(45) Date of Patent: Oct. 30, 2007

(54) UTILITY VACUUM

(75) Inventors: James D. Marshall, Mallorytown (CA); Oleksiy P. Sergyeyenko, Brockville (CA); Ray T. Smith, Leesburg, VA (US); Damon Nawrozki, Baltimore, MD (US); Michelle M. Baldwin, Baltimore, MD (US); Richard P. Rosa, Kingston (CA); Andrew E. Meng, Towson, MD (US)

(73) Assignee: Black & Decker Inc., Newark, DE (US)

( * ) Notice: Subject to any disclaimer, the term of this patent is extended or adjusted under 35 U.S.C. 154(b) by 558 days.

(21) Appl. No.: 10/888,522

(22) Filed: Jul. 10, 2004
(Under 37 CFR 1.47)

(65) Prior Publication Data

US 2005/0055794 A1 Mar. 17, 2005

Related U.S. Application Data

(60) Provisional application No. 60/485,953, filed on Jul. 10, 2003.

(51) Int. Cl.
*A47L 9/00* (2006.01)

(52) U.S. Cl. ..... 15/353; 15/327.6; 55/DIG. 3; 55/417

(58) Field of Classification Search ..... 15/352, 15/353, 327.6; 55/DIG. 3, 410, 417, 418, 55/420

See application file for complete search history.

(56) References Cited

U.S. PATENT DOCUMENTS

| | | | | |
|---|---|---|---|---|
| 1,260,282 | A | 3/1918 | Harrold | 417/368 |
| 2,114,780 | A | 4/1938 | Juelson | 96/339 |
| 2,233,167 | A | 2/1941 | Holm-Hansen | 15/323 |
| 2,276,844 | A | 3/1942 | Holm-Hansen | 55/325 |
| 2,332,208 | A | 10/1943 | Dow | 15/323 |
| 2,731,103 | A | 1/1956 | Ortega | 96/157 |
| 2,757,753 | A | 8/1956 | Kasper | 55/314 |
| 2,818,596 | A | 1/1958 | Martinec | 15/327.2 |

(Continued)

FOREIGN PATENT DOCUMENTS

| | | |
|---|---|---|
| CH | 575748 | 5/1976 |

(Continued)

OTHER PUBLICATIONS

Ryobi Operator's Manual Tuff Sucker™ 18 Volt Cordless Hand Vac Model No. VC180.

(Continued)

*Primary Examiner*—Theresa T. Snider
(74) *Attorney, Agent, or Firm*—Harness, Dickey & Pierce, P.L.C.

(57) ABSTRACT

A utility vacuum that may be configured to employ a disposable bag or removable and reusable container for the collection of dirt and debris that are drawn into the utility vacuum. The utility vacuum may employ one or more movable legs that are movable between an extended position, which provides relatively stable operation of the utility vacuum, and a retracted position, which reduces the footprint of the utility vacuum so that it is easier to store.

12 Claims, 10 Drawing Sheets

U.S. PATENT DOCUMENTS

| | | | | | |
|---|---|---|---|---|---|
| 2,884,185 | A | | 4/1959 | Dolan | 417/368 |
| 2,918,692 | A | | 12/1959 | Martinec | 15/323 |
| 2,935,760 | A | | 5/1960 | Martinec | 15/323 |
| 2,937,395 | A | | 5/1960 | Meyerhoefer | 15/323 |
| 2,937,396 | A | | 5/1960 | Momberg et al. | 15/323 |
| 3,166,777 | A | | 1/1965 | Frantz | 15/323 |
| 3,220,638 | A | | 11/1965 | Petersen | 417/368 |
| 3,383,765 | A | | 5/1968 | Meltzer | 30/123 |
| 3,525,912 | A | | 8/1970 | Wallin | 318/7 |
| 3,609,946 | A | | 10/1971 | Nakagawa et al. | 55/296 |
| 3,730,642 | A | | 5/1973 | Barnstead et al. | 417/423.2 |
| 3,771,191 | A | | 11/1973 | Cain | 15/246.2 |
| 3,775,951 | A | * | 12/1973 | Eichholz et al. | 55/417 |
| 3,869,265 | A | | 3/1975 | Wolter et al. | 15/327.2 |
| 3,874,023 | A | | 4/1975 | Tschudy | 15/326 |
| 3,970,912 | A | | 7/1976 | Hoffman | 320/114 |
| 4,120,616 | A | | 10/1978 | Dwyer et al. | 417/373 |
| 4,179,768 | A | | 12/1979 | Sawyer | 15/352 |
| 4,185,974 | A | | 1/1980 | Hiester | 96/406 |
| 4,330,899 | A | | 5/1982 | Miller et al. | 15/326 |
| 4,523,936 | A | * | 6/1985 | Disanza, Jr. | 15/352 |
| 4,538,971 | A | | 9/1985 | Miller et al. | 417/423.2 |
| 4,541,142 | A | | 9/1985 | Pudwill | 15/323 |
| 4,563,789 | A | | 1/1986 | Berfield | 15/323 |
| 4,623,366 | A | | 11/1986 | Berfield et al. | 96/406 |
| D289,097 | S | | 3/1987 | Takahashi et al. | D32/24 |
| 4,655,694 | A | | 4/1987 | Berfield | 417/423.2 |
| 4,658,465 | A | | 4/1987 | Keane et al. | 15/323 |
| 4,698,530 | A | | 10/1987 | Thomson | 327/410 |
| 4,739,535 | A | | 4/1988 | Schuld et al. | 15/315 |
| 4,748,712 | A | | 6/1988 | DiGiovanni | 15/327.5 |
| 4,811,453 | A | * | 3/1989 | Lubraniecki | 15/352 |
| 4,824,333 | A | | 4/1989 | Erickson, Jr. | 417/360 |
| 4,827,564 | A | | 5/1989 | Brown | 16/18 R |
| 4,838,907 | A | * | 6/1989 | Perry | 15/352 |
| 4,845,793 | A | | 7/1989 | Meyer | 15/328 |
| 4,880,364 | A | | 11/1989 | Berfield et al. | 417/423.1 |
| 4,894,881 | A | * | 1/1990 | Palmer et al. | 15/352 |
| 4,910,828 | A | | 3/1990 | Blase et al. | 15/321 |
| 4,912,593 | A | | 3/1990 | Iwao et al. | 361/215 |
| 4,938,309 | A | | 7/1990 | Emdy | 181/231 |
| 4,939,809 | A | | 7/1990 | Park | 15/328 |
| 4,947,514 | A | | 8/1990 | Gerke, Jr. et al. | 15/339 |
| 5,069,696 | A | | 12/1991 | Bruno, III | 55/476 |
| 5,114,572 | A | | 5/1992 | Hunter et al. | 210/120 |
| 5,205,014 | A | | 4/1993 | Yoo | 15/353 |
| 5,243,733 | A | | 9/1993 | Steiner et al. | 15/330 |
| 5,248,323 | A | | 9/1993 | Stevenson | 95/90 |
| 5,259,854 | A | | 11/1993 | Newman | 55/320 |
| 5,313,686 | A | | 5/1994 | Berfield | 15/323 |
| 5,353,469 | A | | 10/1994 | Fellhauer | 15/326 |
| D352,146 | S | | 11/1994 | Wulff | D32/24 |
| 5,388,301 | A | | 2/1995 | Bosyj et al. | 15/327.1 |
| 5,388,308 | A | | 2/1995 | Meeuwissen | 16/340 |
| 5,400,464 | A | | 3/1995 | Steiner | 15/330 |
| 5,404,614 | A | | 4/1995 | Stephens | 15/327.2 |
| D358,010 | S | | 5/1995 | Berfield et al. | D32/23 |
| 5,412,837 | A | | 5/1995 | Wörwag | 15/353 |
| RE34,980 | E | | 6/1995 | Rau et al. | 55/467 |
| 5,455,984 | A | | 10/1995 | Blase | 15/339 |
| 5,528,794 | A | | 6/1996 | Tomasiak | 15/323 |
| 5,535,500 | A | | 7/1996 | Stephens et al. | 29/453 |
| 5,548,868 | A | | 8/1996 | Berfield et al. | 15/339 |
| 5,561,885 | A | | 10/1996 | Zahuranec et al. | 15/323 |
| 5,592,716 | A | | 1/1997 | Moren et al. | 15/412 |
| 5,606,769 | A | | 3/1997 | Tomasiak et al. | 15/327.6 |
| 5,608,945 | A | | 3/1997 | Crouser et al. | 15/328 |
| 5,611,107 | A | | 3/1997 | Tomasiak et al. | 15/327.2 |
| 5,623,744 | A | | 4/1997 | Triplett et al. | 15/326 |
| 5,644,815 | A | | 7/1997 | Bosyj et al. | 15/328 |
| D383,575 | S | | 9/1997 | Griffin | D32/23 |
| 5,666,688 | A | | 9/1997 | Kim | 15/323 |
| D386,842 | S | | 11/1997 | Hoshino et al. | D32/21 |
| D389,962 | S | | 1/1998 | Berfield et al. | D32/23 |
| D398,100 | S | | 9/1998 | Stephens et al. | D32/23 |
| 5,829,092 | A | | 11/1998 | Hobbs | 15/352 |
| 5,844,328 | A | | 12/1998 | Furst | 307/66 |
| 5,870,798 | A | | 2/1999 | Crouser et al. | 15/321 |
| 5,943,731 | A | | 8/1999 | Wood | 15/323 |
| 5,943,732 | A | | 8/1999 | Bosyj et al. | 15/328 |
| 5,954,863 | A | | 9/1999 | Loveless et al. | 96/321 |
| 5,966,775 | A | | 10/1999 | Berfield | 15/353 |
| 5,969,954 | A | | 10/1999 | Zaitsu | 363/16 |
| 5,998,965 | A | | 12/1999 | Carlucci et al. | 320/111 |
| 6,003,200 | A | | 12/1999 | Potts et al. | 15/413 |
| 6,003,300 | A | | 12/1999 | Bates | 40/204 |
| D418,643 | S | | 1/2000 | Hoshino | D32/21 |
| 6,009,596 | A | | 1/2000 | Buss et al. | 15/353 |
| D422,386 | S | | 4/2000 | Jaros et al. | D32/21 |
| 6,049,940 | A | | 4/2000 | Robitaille | 15/319 |
| 6,052,862 | A | | 4/2000 | Lowery | 15/323 |
| 6,055,700 | A | | 5/2000 | Holsten et al. | 15/327.2 |
| D429,042 | S | | 8/2000 | Griffin et al. | D32/23 |
| D429,856 | S | | 8/2000 | Griffin | D32/23 |
| 6,098,241 | A | | 8/2000 | Wood | 15/323 |
| 6,101,669 | A | | 8/2000 | Martin et al. | 15/327.2 |
| 6,104,162 | A | | 8/2000 | Sainsbury et al. | 320/11 |
| 6,113,663 | A | | 9/2000 | Liu | 55/459.1 |
| 6,141,823 | A | | 11/2000 | Fujiwara et al. | 15/330 |
| 6,156,198 | A | | 12/2000 | Bartels | 210/315 |
| 6,158,083 | A | | 12/2000 | Holsten | 15/326 |
| 6,162,287 | A | | 12/2000 | Rohn et al. | 96/333 |
| 6,172,437 | B1 | | 1/2001 | Du | 310/136 |
| 6,174,350 | B1 | | 1/2001 | Rohn et al. | 95/218 |
| 6,175,988 | B1 | | 1/2001 | White et al. | |
| 6,181,029 | B1 | | 1/2001 | Berglund et al. | |
| 6,192,551 | B1 | | 2/2001 | Roth | |
| D439,710 | S | | 3/2001 | Griffin | D32/31 |
| 6,219,880 | B1 | | 4/2001 | Worden et al. | |
| 6,237,187 | B1 | | 5/2001 | Hult et al. | 15/323 |
| D446,612 | S | | 8/2001 | Köhler | D32/21 |
| D447,844 | S | | 9/2001 | Griffin | D32/31 |
| 6,290,761 | B2 | | 9/2001 | Rohn et al. | 96/333 |
| 6,300,744 | B1 | | 10/2001 | Shum | |
| 6,312,508 | B1 | | 11/2001 | Alberts, III et al. | 96/333 |
| 6,321,410 | B1 | | 11/2001 | Holsten | 15/327.2 |
| 6,347,430 | B1 | | 2/2002 | Buss et al. | 15/353 |
| 6,361,587 | B1 | | 3/2002 | Rohn et al. | 95/218 |
| 6,363,574 | B2 | | 4/2002 | Worden et al. | |
| 6,367,118 | B1 | | 4/2002 | Berfield | 15/323 |
| 6,378,165 | B1 | | 4/2002 | Holsten et al. | 15/410 |
| 6,432,180 | B2 | | 8/2002 | Alberts, III et al. | 96/333 |
| 6,440,191 | B1 | | 8/2002 | Berfield et al. | |
| D462,488 | S | | 9/2002 | Santiago et al. | D32/18 |
| 6,448,732 | B1 | | 9/2002 | Block | |
| 6,451,078 | B2 | | 9/2002 | Berfield et al. | |
| 6,459,604 | B1 | | 10/2002 | Youn et al. | |
| 6,484,351 | B2 | | 11/2002 | Griffin et al. | 15/329 |
| 6,499,182 | B2 | | 12/2002 | Berfield et al. | |
| 6,502,276 | B2 | | 1/2003 | Iversen | 15/323 |
| 6,502,778 | B2 | | 1/2003 | Kim | 242/385.4 |
| 6,508,867 | B2 | | 1/2003 | Schoenewald et al. | 96/333 |
| 6,510,583 | B2 | | 1/2003 | Griffin et al. | 15/323 |
| 6,530,116 | B2 | | 3/2003 | Berfield et al. | 15/328 |
| 6,543,085 | B2 | | 4/2003 | Holsten et al. | 15/410 |
| 6,565,637 | B2 | | 5/2003 | Alberts, III et al. | 96/333 |
| 6,588,052 | B2 | | 7/2003 | Iversen | 15/323 |
| 2001/0000196 | A1 | | 4/2001 | Rohn et al. | 96/333 |
| 2001/0005919 | A1 | | 7/2001 | Worden et al. | 15/413 |
| 2001/0015132 | A1 | | 8/2001 | Rohn et al. | 95/226 |
| 2002/0066153 | A1 | | 6/2002 | Sclafani et al. | 15/347 |
| 2002/0108205 | A1 | | 8/2002 | Berfield et al. | 15/328 |
| 2002/0121000 | A1 | | 9/2002 | Tyler | 15/412 |
| 2002/0124345 | A1 | | 9/2002 | Holsten et al. | 15/353 |

| | | | | |
|---|---|---|---|---|
| 2002/0138937 | A1 | 10/2002 | Griffin et al. | 15/323 |
| 2002/0138938 | A1 | 10/2002 | Griffin et al. | 15/328 |
| 2002/0174508 | A1 | 11/2002 | Iversen | 15/323 |
| 2002/0178530 | A1 | 12/2002 | Iversen | 15/323 |

FOREIGN PATENT DOCUMENTS

| | | |
|---|---|---|
| DE | GM 78 07 797 | 3/1978 |
| DE | 29 45 865 | 11/1979 |
| DE | GM 80 13 467 | 5/1980 |
| DE | G 82 22 409.9 | 8/1982 |
| DE | 34 05 749 | 2/1984 |
| DE | G 88 01 964.0 | 2/1988 |
| DE | 38 32 648 | 9/1988 |
| DE | 41 26 320 | 8/1991 |
| DE | M 92 00 148 | 1/1992 |
| DE | M 92 00 522 | 1/1992 |
| DE | 42 37 774 | 11/1992 |
| DE | 43 38 330 | 10/1993 |
| DE | 43 17 002 | 4/1994 |
| DE | 44 13 243 | 4/1994 |
| DE | M 96 01 589 | 2/1996 |
| DE | M 96 07 135 | 8/1996 |
| DE | M 97 00 637 | 1/1997 |
| DE | M 97 03 516 | 4/1997 |
| DM | 005 742 | 8/1985 |
| DM | 023 075 | 6/1992 |
| DM | 040 832 | 7/1997 |
| EP | 0 610 545 | 9/1993 |
| EP | 0564817 A1 | 10/1993 |
| EP | 0 537 470 | 1/1996 |
| EP | 0 729 211 | 8/1996 |
| EP | 0 956 806 | 4/1999 |
| WO | WO 02/074150 A1 | 9/2002 |
| WO | WO 02/080750 | 10/2002 |

OTHER PUBLICATIONS

Ryobi Operator's Manual 7.2 Volt Cordless Hand Vac Model No. VC722.

Sharp Corporation Press Release "EC-CL20 Functions as Both Cordless Cleaner and AC Powered Cleaner, a World-First* for a Cyclonic Vacuum Cleaner" dated Feb. 1, 2002.

* cited by examiner

UTILITY VACUUM

This application claims the benefit of U.S. Provisional Application No. 60/485,953 filed Jul. 10, 2003.

FIELD OF THE INVENTION

The present invention generally relates to vacuum appliances and more particularly to a portable wet/dry utility vacuum having improved convenience and performance.

BACKGROUND OF THE INVENTION

It is relatively commonplace to find two types of vacuums in modern households: one that is suited for vacuuming floors and carpets, such as an upright vacuum or a canister-type vacuum, and another for relatively heavy-duty cleaning tasks, such as a wet/dry vacuum.

Utility vacuums, also known as wet/dry vacuums, are commonly employed in the basements, garages and/or work shops of modern households for relatively heavy-duty cleaning tasks. While the known utility vacuums work for their intended purpose, we have noted several drawbacks with their configurations.

One such drawback concerns the manner in which dirt and debris are commonly stored or held by the utility vacuum. In this regard, the known utility vacuums include a housing and a power head. The housing is commonly cylindrically shaped and defines a dirt cavity with an open top. The power head includes a motor, a fan, and a filter assembly and a mounting flange or plate to which the motor, fan and filter assembly are coupled. The mounting flange is configured to seal the open top of the housing to thereby trap dirt and debris in the dirt cavity. With that in mind, removal of the mounting flange for any reason (e.g., emptying the dirt cavity, changing or cleaning the filter assembly) exposes the user to the dirt and debris contained therein. Furthermore, as the dirt and debris commonly adheres to any of the internally exposed surfaces of the power head (e.g., to the mounting flange and filter assembly), the user must contend with the dirt and debris that dislodge from the power head when it is removed to permit access to the dirt cavity.

Another drawback with the known utility vacuums concerns the emptying of the dirt cavity. In this regard, it is fairly common for the housing to include a substantial rib or bead at its open end to structurally support the power head. This rib or bead typically necks-down the dirt cavity, forming a ledge or ridge that greatly encumbers the removal of the dirt and debris from the dirt cavity. Furthermore, if the dirt and debris are moist or if water is introduced to the dirt cavity, the dirt and debris tends to adhere to the sides of the housing.

Yet another drawback concerns the overall size and portability of the known utility vacuums. The known utility vacuums tend to either utilize a relatively large footprint, which renders the utility vacuum stable during use but relatively difficult to store, or a relatively small footprint, which renders the utility vacuum relatively easy to store but relatively unstable (i.e., tip-able) during use. Furthermore, the known configurations typically do not accommodate the moving of the utility vacuum over relatively long-distances. In this regard, the user must typically lift the utility vacuum and hand carry it to the desired location.

A further drawback of the known configuration concerns the storage of tools and accessories that are commonly employed with the utility vacuum. In some instances, no provisions are made for the storage of tools and accessories.

In those situations, the user may temporarily store these items in the dirt cavity, but would then have to remove them prior to each use of the utility vacuum and hand-carry them as needed. Although pockets or the like could alternatively be formed into the exterior surface of the housing for retaining the tools and accessories, this approach would tend to adversely effect tooling costs (due to the increased complexity of the tool) and would also render the cleaning of the dirt cavity more difficult due to the contouring of inside surface of the housing. With regard to the latter point, the housings of the known utility vacuums are relatively thin walled and as such, the formation of pockets or the like into the exterior of the housing would likewise-form protrusions or discontinuities on the interior surface of the housing that would tend to collect and retain dirt and debris.

Accordingly, there remains a need in the art for an improved utility vacuum that overcomes the aforementioned drawbacks.

SUMMARY OF THE INVENTION

In one form, the present teaching provide a utility vacuum that is stable in operation but which has a relatively small footprint that renders the utility vacuum easier to store. The present invention employs legs for mounting a set of wheels to the canister of utility vacuum. The legs are movable between an extended position, which provides relatively stable operation of the utility vacuum, and a retracted position, which reduces the footprint of the utility vacuum so that it is easier to store.

In another form, the present teachings provide a utility vacuum that is relatively less messy to operate. In one aspect, the utility vacuum is configured to employ a disposable bag or removable and reusable container for the collection of dirt and debris that are drawn into the utility vacuum. Construction in this manner reduces or eliminates contact between the user of the utility vacuum and the dirt and debris. In another aspect, the utility vacuum is configured to employ a prefilter screen that is disposed between the primary filter and the cavity in the utility vacuum that holds the dirt and debris. The prefilter screen reduces the dirt and debris that are deposited onto the powerhead assembly of the utility vacuum so that the user is exposed to less dirt and debris when it is necessary to remove the powerhead assembly (for the emptying of the canister housing).

In a further form, the present teachings provide a utility vacuum with improved ergonomics. In one aspect, the present teachings provide a utility vacuum with a handle that may be extended so that the user does not have to lift the entire unit or stoop to push or pull the unit when the utility vacuum is to be transported. In another aspect of the invention, the utility vacuum is further provided with a set of wheels that fully carry the weight of the utility vacuum (and its contents) when the handle assembly is employed.

In another form, the present teachings provide a utility vacuum with an accessory apron for the convenient storage and transport of tools and accessories that are employed with the utility vacuum.

In yet another form, the present teachings provide a power dust pan attachment for a vacuum. The power dust pan attachment includes a dust pan into which dirt and debris may be swept. The dust pan is coupled in fluid connection to the vacuum such that the dirt and debris swept therein are drawn into the vacuum.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENTS

Figure 1:
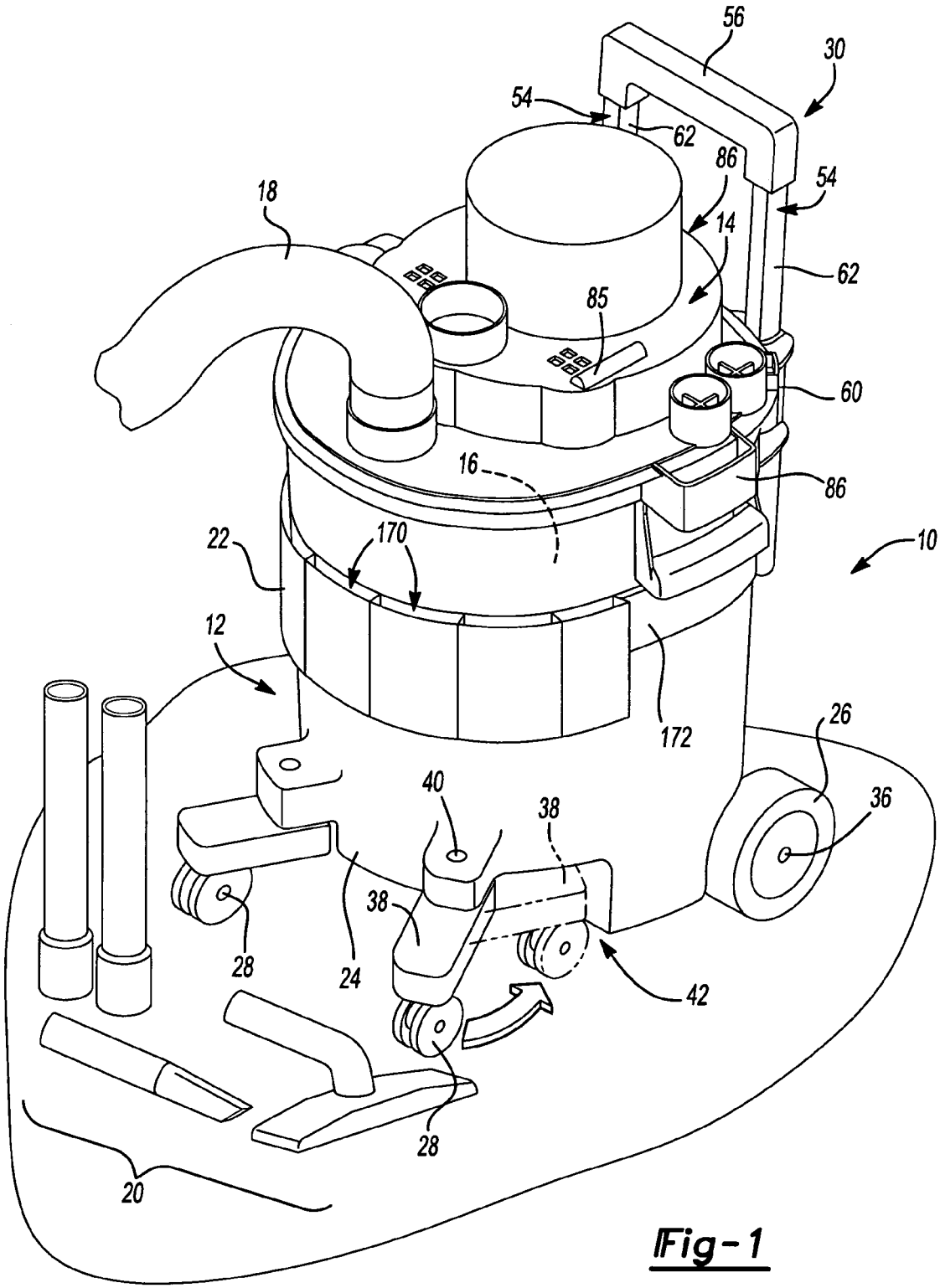
FIG. 1 is a perspective view of a utility vacuum constructed in accordance with the teachings of the present invention.

With reference to FIG. 1 of the drawings, a hand-portable wet/dry vacuum constructed in accordance with the teachings of the present invention is generally indicated by reference numeral 10. The vacuum 10 is shown to include a canister assembly 12, a powerhead assembly 14, a filter system 16, a hose assembly 18, a plurality of conventional hose-end attachments 20 and an accessory apron 22.

Figure 2:
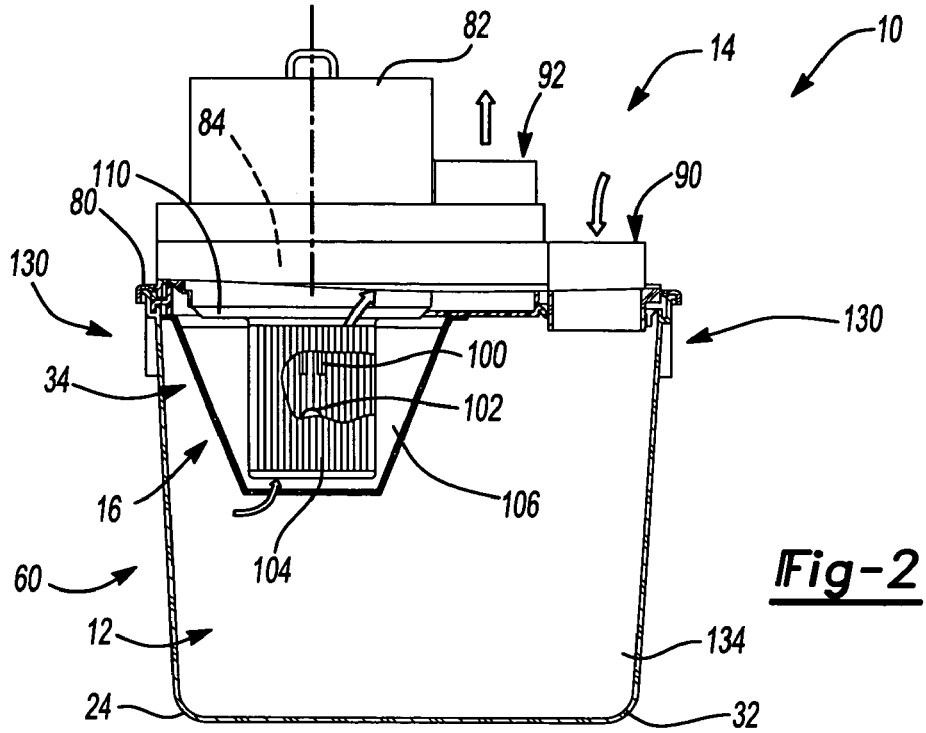
FIG. 2 is a longitudinal sectional view of the utility vacuum of FIG. 1.

With additional reference to FIG. 2, the canister assembly 12 includes a canister housing 24, a first set of wheels 26, a second set of wheels 28 and a handle assembly 30. The canister housing 24 is cup or pail like in shape so as to define a central cavity 32 with a generally open top 34.

In the example illustrated, an axle 36 is employed to couple the first set of wheels 26 to the canister housing 24. More specifically, the axle 36 extends through and is rotatably supported by a portion of the canister housing 24 and the first wheels 26 are coupled to the opposite ends of the axle 36 in a conventional and well known manner, such as via push nuts (not specifically shown) or press-fitting, so that the first wheels 26 overhang the canister housing 24. The first set of wheels 26 is sized and positioned so that each of the first wheels 26 protrudes from the canister housing 24 so as to remain in rolling contact with treads and risers of a set of stairs (not shown) as the utility vacuum 10 is pulled up or lowered down the stairs.

The second set of wheels 28, which are preferably casters, are illustrated to be coupled to the canister housing 24 in the embodiment provided so as to be movable between an extended position, which is illustrated in FIG. 1 in solid line, and a retracted position, which is illustrated in FIG. 1 in phantom line. Positioning of the second set of wheels 28 in the extended position provides the utility vacuum 10 with a relatively large footprint that is relatively stable, while positioning of the second set of wheels 28 in the retracted position provides the utility vacuum 10 with a relatively small footprint that renders the utility vacuum 10 somewhat easier to store.

Figure 3:
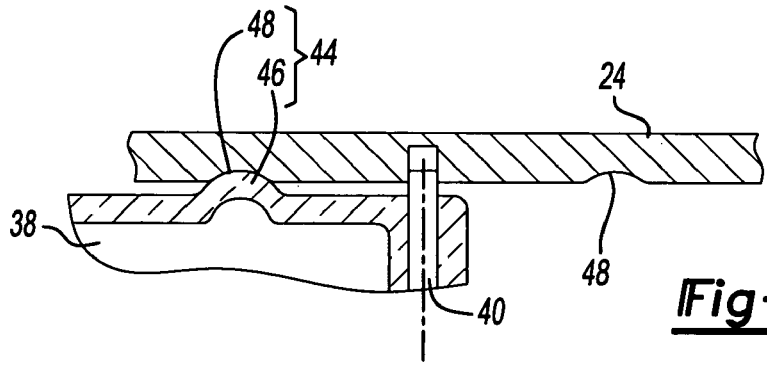
FIG. 3 is a sectional view of a portion of the utility vacuum of FIG. 1 illustrating the latch for the legs in greater detail.
Figure 6:
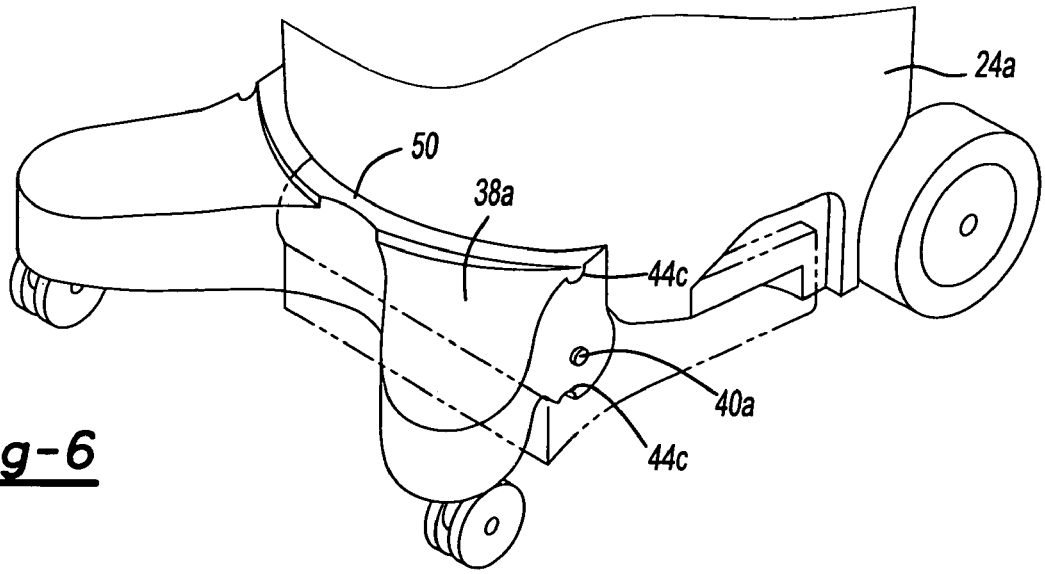
FIG. 6 is a perspective view of a portion of the utility vacuum of FIG. 4 illustrating the mounting of the legs to the canister housing in greater detail.

In the embodiment illustrated, each of the second wheels 28 is mounted to a leg 38 that is pivotably mounted via a pivot pin 40 such that the leg 38 is rotatable about an axis that is generally parallel to the longitudinal axis of the canister housing 24. In the example illustrated, the canister housing 24 includes recessed portions 42 that are sized to receive an associated one of the legs 38 when they are positioned in the retracted position. Alternatively or additionally, each leg 38 could be configured to match the contour of the canister housing 24 to permit the recessed portions 42 to be reduced in their size or eliminated altogether. A latch 44, which may consist of a detent ball 46 formed on the leg 38 and a mating socket 48 formed on the canister housing 24, as shown in FIG. 3, is employed to inhibit undesired movement of the legs 38 between the extended and retracted positions.

Although the legs 38 have been illustrated and discussed as rotating laterally with respect to the canister housing 24, those skilled in the art will appreciate that the invention, in its broadest aspect, may be constructed somewhat differently. In FIGS. 4 through 7, for example, the legs **38*a* are illustrated to be mounted via an axle 40*a* such that the legs 38*a* are rotatable about an axis that is generally perpendicular to the longitudinal axis of the canister housing 24*a*. A latch 44*a* may be employed to maintain the legs 38*a* in one or both of the extended and retracted positions. The latch may include a shot pin (not shown), for example, that engages both the leg 38***a* and the canister housing 24*a* so that the legs 38*a* may be maintained in one or both of the extended and retracted positions. Alternatively, a spring 44*b* may be employed to engage a detent 44*c* in the leg 38*a* to maintain the leg 38*a* in the extended or retracted position. Also alternatively, a spring (not shown), such as a torsion spring, may be employed to bias the legs 38*a* into the retracted position. The canister housing 24*a* differs somewhat from the canister housing 24 of FIG. 1 in that an optional foot 50 is formed between the legs 38*a*. The foot 50 is sized so that it is elevated from the ground somewhat when the legs 38*a* are placed in the extended position and contact the ground when the legs 38*a* are placed in the retracted position to thereby carry a portion of the weight of the utility vacuum 10.

Figure 8:
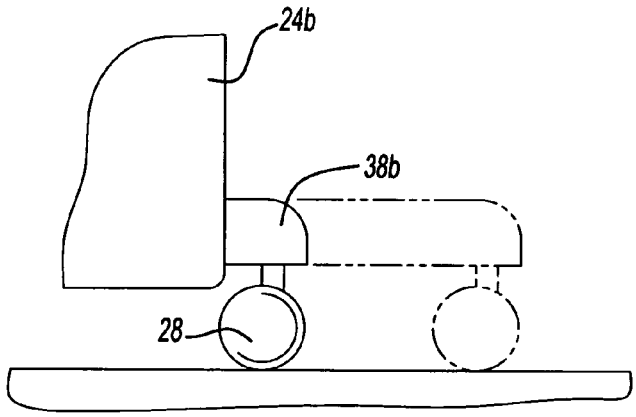
FIG. 8 is a schematic illustration of a utility vacuum similar to that of FIG. 1 but illustrating yet another configuration of the mounting of the legs to the canister housing.

FIG. 8 illustrates yet another example of the implementation of our movable legs 38*b*. In this embodiment, the legs 38*b* do not rotate but rather are telescopically mounted to the canister housing 24*b* so as to be movable between the extended position (illustrated in phantom line) and the retracted position (illustrated in solid line).

Handle Assembly

Figure 4:
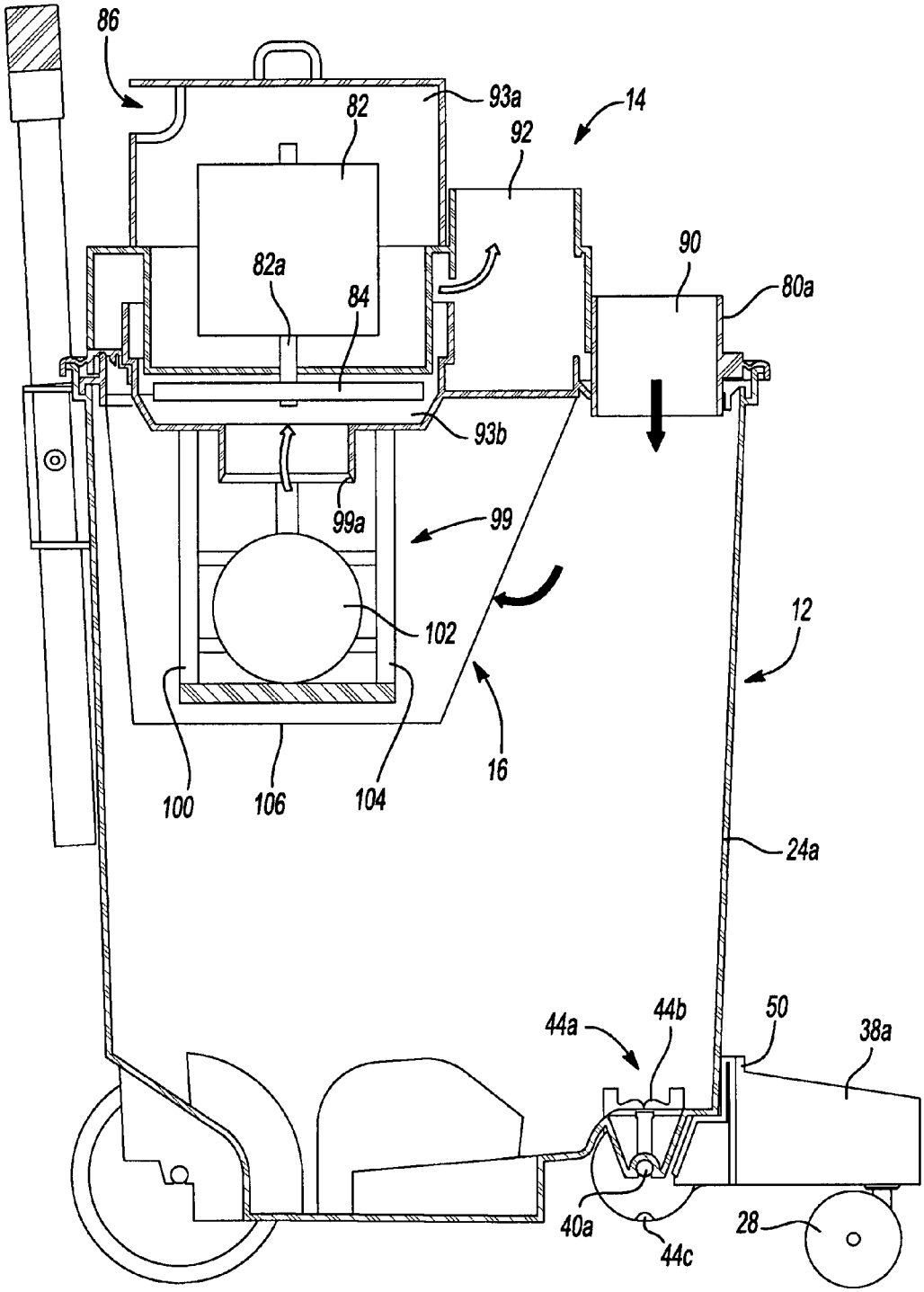
FIG. 4 is a longitudinal section view of a second utility vacuum constructed in accordance with the teachings of the present invention, the utility vacuum being similar to that of FIG. 1 but illustrating another configuration of the mounting of the legs to the canister housing.
Figure 7:
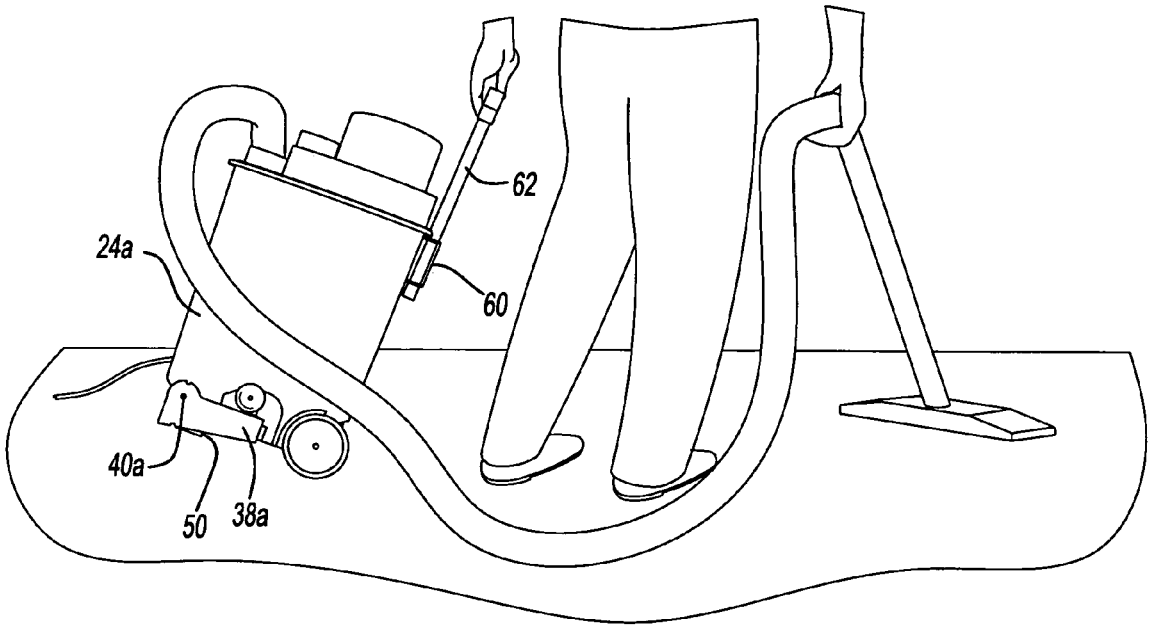
FIG. 7 is a perspective view of the utility vacuum of FIG. 4 illustrating the legs in a retracted position and the handle assembly in an extended position.
Figure 9:
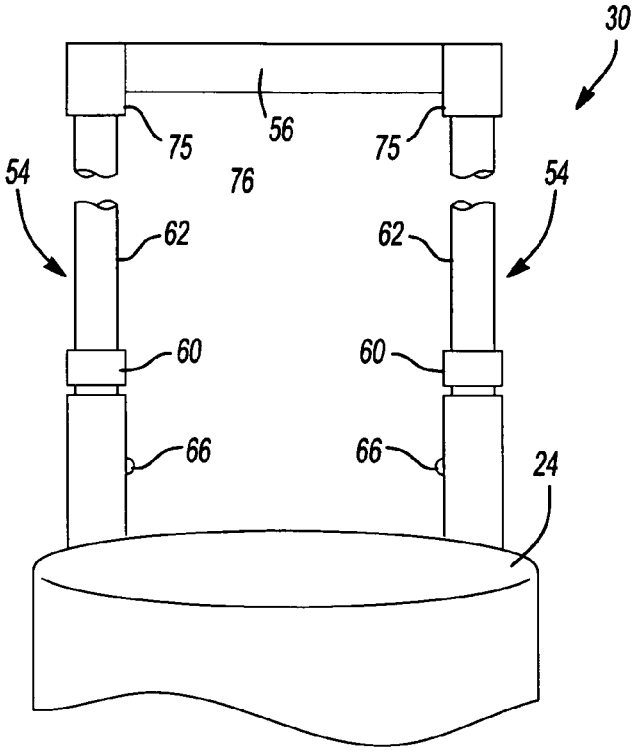
FIG. 9 is a front view of a portion of the utility vacuums of FIGS. 1 and 4 illustrating the handle assembly in greater detail.

Returning to FIG. 1, the handle assembly 30 is illustrated to include a pair of tube assemblies 54 and a handle 56. With reference to FIG. 9, each of the tube assemblies 54 includes a lower tube 60, which is coupled to the canister housing 24, and an upper tube 62 that is telescopically received into the lower tube 60. The handle 56 is coupled to the upper tube 62 of each tube assembly 54 and may be a discrete component that is fixedly coupled to the upper tubes 62 at its opposite ends or may be unitarily formed with the upper tubes 62. The handle 56 of the handle assembly 30 is movable between a retracted position, which is illustrated in FIG. 4, wherein each of the upper tubes 62 is substantially telescopically received into its associated lower tube 60, and an extended position, which is illustrated in FIG. 7 and wherein each of the upper tubes 62 is substantially telescopically extended from its associated lower tube 60.

Figure 10:
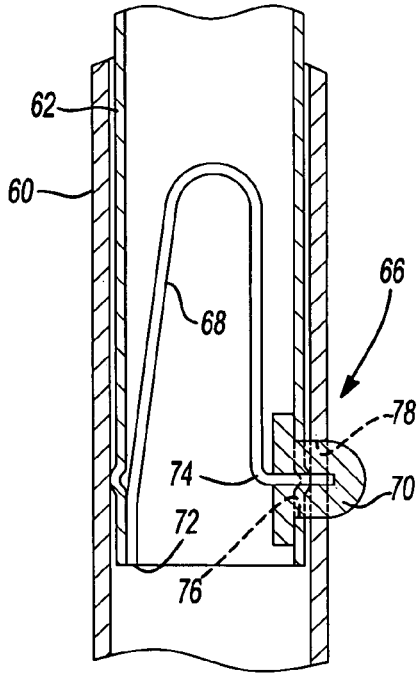
FIG. 10 is a sectional view of a portion of the handle assembly illustrating an exemplary construction of a tube assembly.

Preferably, the handle assembly 30 also includes a latch 66 that may be employed to latch the upper tube 62 of one tube assembly 54 relative to its associated lower tube 60. With additional reference to FIG. 10, the latch 66 in the example provided is shown to include a leaf spring 68 and a plunger 70. The leaf spring 60 is disposed inside to the upper tube 62 and includes a fixed end 72 that is fixedly coupled to the upper tube 62. The opposite (free) end 74 of the leaf spring 68 is coupled to the plunger 70 and exerts a force thereon which biases the plunger 70 into a first plunger aperture 76 that is formed in the upper tube 62. A corresponding second plunger aperture 78 is formed in the lower tube 60 that is sized to receive the plunger 70 therethrough.

When the handle 56 is positioned in the extended position, the first and second plunger apertures 76 and 78 are aligned to one another and the plunger 70, in response to the force exerted onto it by the leaf spring 68, extends through the lower tube 60 to thereby releasably secure the lower and upper tubes 60 and 62 to one another. Thereafter, the handle 56 may be returned to the retracted position by depressing the plunger 70 and pushing the handle 56 downward.

Movement of the handle 56 into the extended position permits the user to push or pull the utility vacuum 10 in a comfortable and upright stance. This is particularly helpful, for example, when the central cavity 32 of the utility vacuum 10 is full and relatively heavy (as when it contains a large amount of water, for example) and the utility vacuum 10 is to be transported up or down a set of stairs. Movement of the handle 56 into the retracted position permits the overall size of the utility vacuum 10 to be reduced for more efficient storage.

Figure 11:
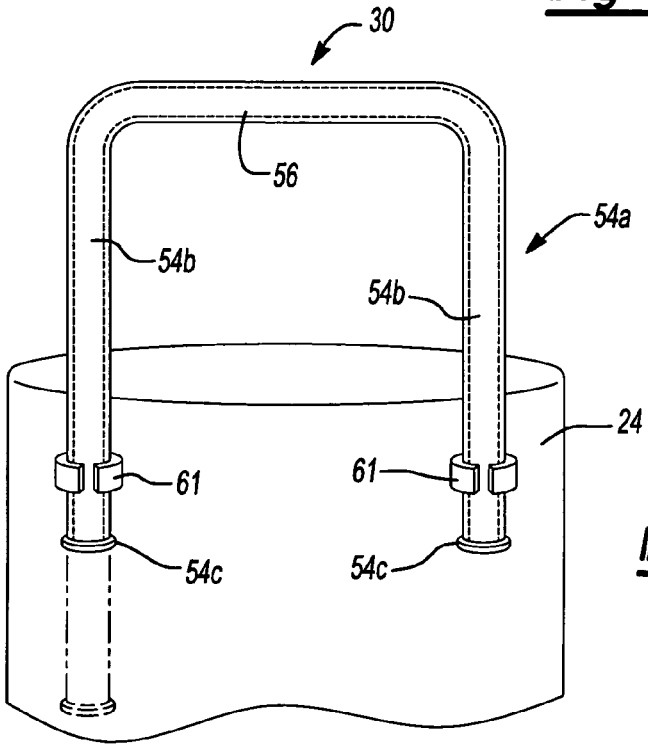
FIG. 11 is a rear view of a portion of another utility vacuum constructed in accordance with the teachings of the present invention illustrating an alternately constructed handle assembly.

Although the handle assembly 30 has been described thus far as including a pair of telescoping tube assemblies 54 that are interconnected by a handle 56, those skilled in the art will appreciate that the invention, in its broadest aspects, may be constructed somewhat differently. For example, the handle assembly 30 may be constructed from a single U-shaped tube as illustrated in FIG. 11. In this embodiment, a single tube 54*a* is bent in a U-shape so that its legs 54*b* are coupled to the opposite ends of the handle 56. The legs 54*b* are slidably received into retaining clips 61 that are coupled to or integrally formed with the canister housing 24. A rolled edge 54*c* formed on the end of each leg 54*b* opposite the handle 56 limits an amount by which the legs 54*b* may be withdrawn from their respective retaining clip 61.

Powerhead Assembly

With renewed reference to FIG. 4, the powerhead assembly 14 is illustrated to be removably attached to the canister assembly 12 and includes a housing 80, a motor 82, a fan 84, a clogged filter indicator 85 and at least one handle 86. The housing 80 defines a lid 88, an inlet port 90, an outlet port 92 and a fan housing portion 94 with at least one cavity (e.g., 93*a*, 93*b* FIG. 4) into which the motor 82 and fan 84 are housed. The inlet port 90 is routed to the canister assembly 12 on a first side of the filter system 16 while the outlet port 92 is routed to the canister assembly 12 on a second side of the filter system 16. Alternatively, the inlet port 90 may be integrally formed with the canister housing 24. Air flowing into the inlet port 90 flows into the canister assembly 12 and through the filter system 16 prior to being directed out of the outlet port 92. The motor 82 and the fan 84, which is coupled for rotation with the output shaft 82*a* of the motor 82, cooperate to blow air out of the outlet port 92 to thereby draw air into the powerhead assembly 14 via the inlet port 90. The clogged filter indicator 85 is generally similar to that which is described in copending U.S. Provisional Patent Application Ser. No. 60/449,987 filed Feb. 26, 2006 entitled "Vacuum With Filter Indicator", the disclosure of which is hereby incorporated by reference as if fully set forth herein. Alternatively, the clogged filter indicator 85 may be constructed in a manner that is generally similar to that which is described in U.S. Pat. No. 4,416,033 entitled "Full Bag Indicator", the disclosure of which is hereby incorporated by reference as if fully set forth herein. The handle 86 permits the user to lift the powerhead assembly 14 when removing the powerhead assembly 14 from or replacing the powerhead assembly 14 to the canister assembly 12. In the example illustrated, the powerhead assembly 14 includes two handles 86 on its lateral sides and one handle 86 on its rear surface. As those skilled in the art will appreciate, the handles 86 may be discrete components that are coupled to the powerhead assembly 14 or may be integrally formed with a component of the powerhead assembly 14, such as the housing 80.

The filter system 16 includes a valve 99, a primary filter 104 and a prefilter 106. The primary filter 104 is a conventional pleated paper filter with an upper gasket 110 that sealingly engages a portion of housing 80 around the inlet to the fan 84.

The valve 99 is operable for inhibiting fluids, such as water, from entering the cavity (e.g., 93*a* and/or 93*b*) that houses the motor 82 and/or the fan 84 when the canister housing 24 is filled to a predetermined level with a fluid. In the particular example provided, the valve 99 employs a float 102 that is employed to block the entry of fluids into the cavity 93*a* when a fluid level in the canister housing 24 reaches a predetermined level. In the example provided, the float 102 is a weighted spherical ball of the type that is known in the art and is configured to engage a concave surface 99*a* that is formed on the inlet portion 80*a* of the housing 80.

In the example provided, a cage structure 100 is coupled to the housing 80 in-line with the fan 84. The cage structure 100 houses the float 102 such that the float 102 is movable within the filter cage 100 in a direction that is generally perpendicular to the longitudinal axis of the canister housing 24 between a first position, which clears the inlet to the fan 84, and a second condition. In the second condition, the outer surface of the float 102 conforms to the concave surface 99*a* on the inlet portion 80*a* of the housing 80 to thereby seal or close the cavity 93*b*.

Figure 12:
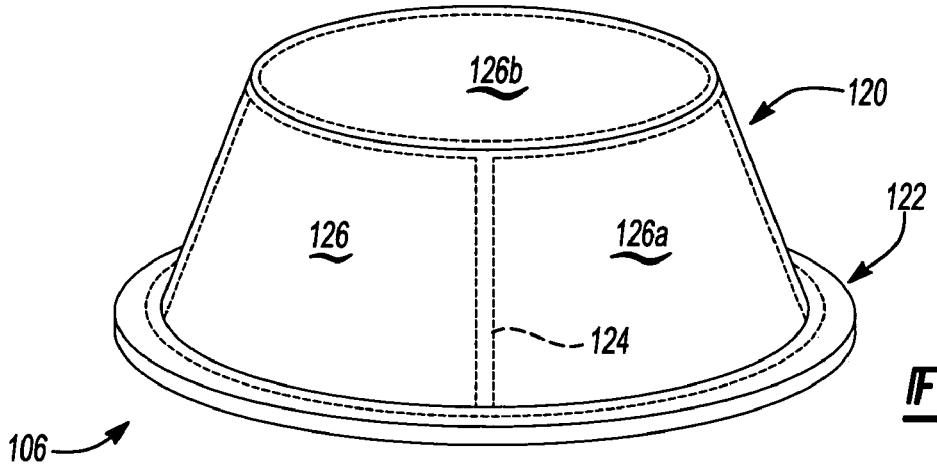
FIG. 12 is a perspective view of a portion of the utility vacuums of FIGS. 1 and 4 illustrating the prefilter screen in greater detail.

With additional reference to FIG. 12, the exemplary prefilter 106 provided has a body 120 and a rim or abutting flange 122 and is intended to be disposable, but those skilled in the art will appreciate that the prefilter 106 could also be removable and washable (cleanable). The body 120 includes an optional support structure 124 and at least one panel 126 that is formed from a suitable paper, fabric, screen or mesh material. The support structure 124 has a truncated conical shape to which the abutting flange 122 and the panel 126 are coupled. The panel 126 is fitted about and fixedly coupled to the side 126*a* and optionally the bottom 126*b* of the prefilter 106. Alternatively, the panel 126 is removable from the support structure 124 so that the support structure 124 may be reused.

The abutting flange 122 is configured to overlie a portion of the top surface of the canister housing 24. In this way, the user may simply drop the prefilter 106 onto the canister housing 24 and secure the powerhead assembly 14 to the canister housing 24 with a latch 130 to thereby clamp the abutting flange 122 between the canister housing 24 and the housing 80 of the powerhead assembly 14. When it becomes necessary to empty the central cavity 32 in the canister housing 24, the user may remove the powerhead assembly 14 from the canister assembly 12 and dispose of the prefilter screen as well as the contents of the central cavity 32.

Optionally, a removable and re-usable container or a disposable bag 134, which is illustrated in FIG. 4, may be disposed in the interior of the canister housing 24 to collect and hold the dirt and debris that are collected by the utility vacuum 10. Such disposable bag 134 or removable container permits the prefilter 106 to be removed from the canister housing 24 in a manner that does not disturb (and release) the dirt and debris that are captured in the panel 126 so that the entire contents of the disposable bag 134 or removable container may be disposed of, or optionally transported to a suitable location, such as outdoors, where the prefilter 106 may be removed and cleaned.

Figure 13:
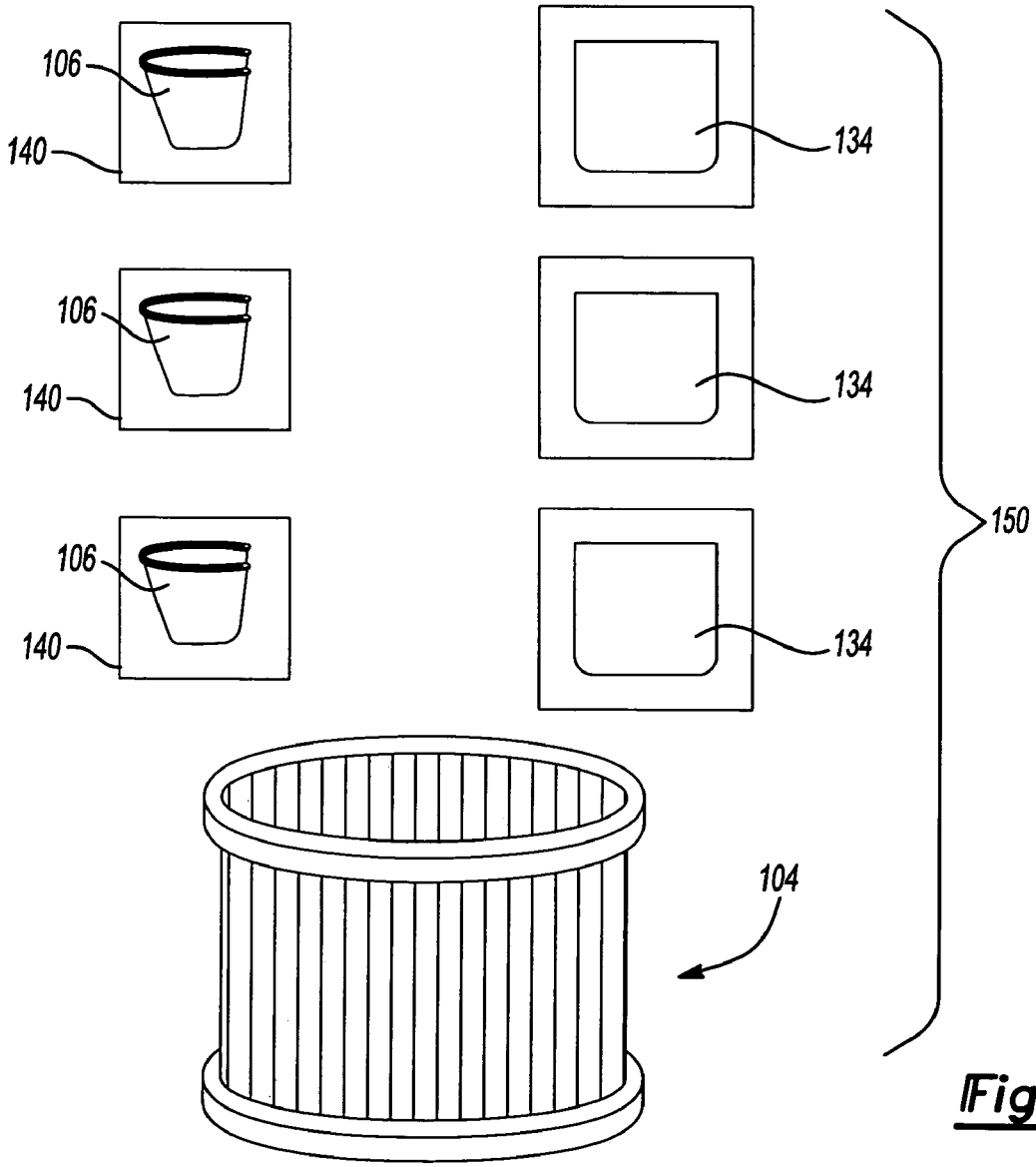
FIG. 13 is a schematic view of a filter kit for use with the utility vacuums of FIGS. 1 and 4.

The construction of the prefilter 106 also permits the prefilter 106 to be collapsed and stored in a flat and relatively small package 140 as shown in FIG. 13. In this regard, the prefilter 106 is easily collapsed by twisting diametrically opposite ends of the abutting flange 122 through an angle of 180° to form three overlaying coils. As such, several of the prefilter screens 106 may readily be packaged in a kit 150 with an associated quantity of disposable bags 134, and optionally a primary filter 104. Packaging of the kit 150 in this manner is advantageous in that it prompts the user to replace both the disposable bag 134 and the prefilter 106 at the same time, as well as to replace the primary filter 104 at a predetermined interval (i.e., when the kit 150 is first used).

Figure 5:
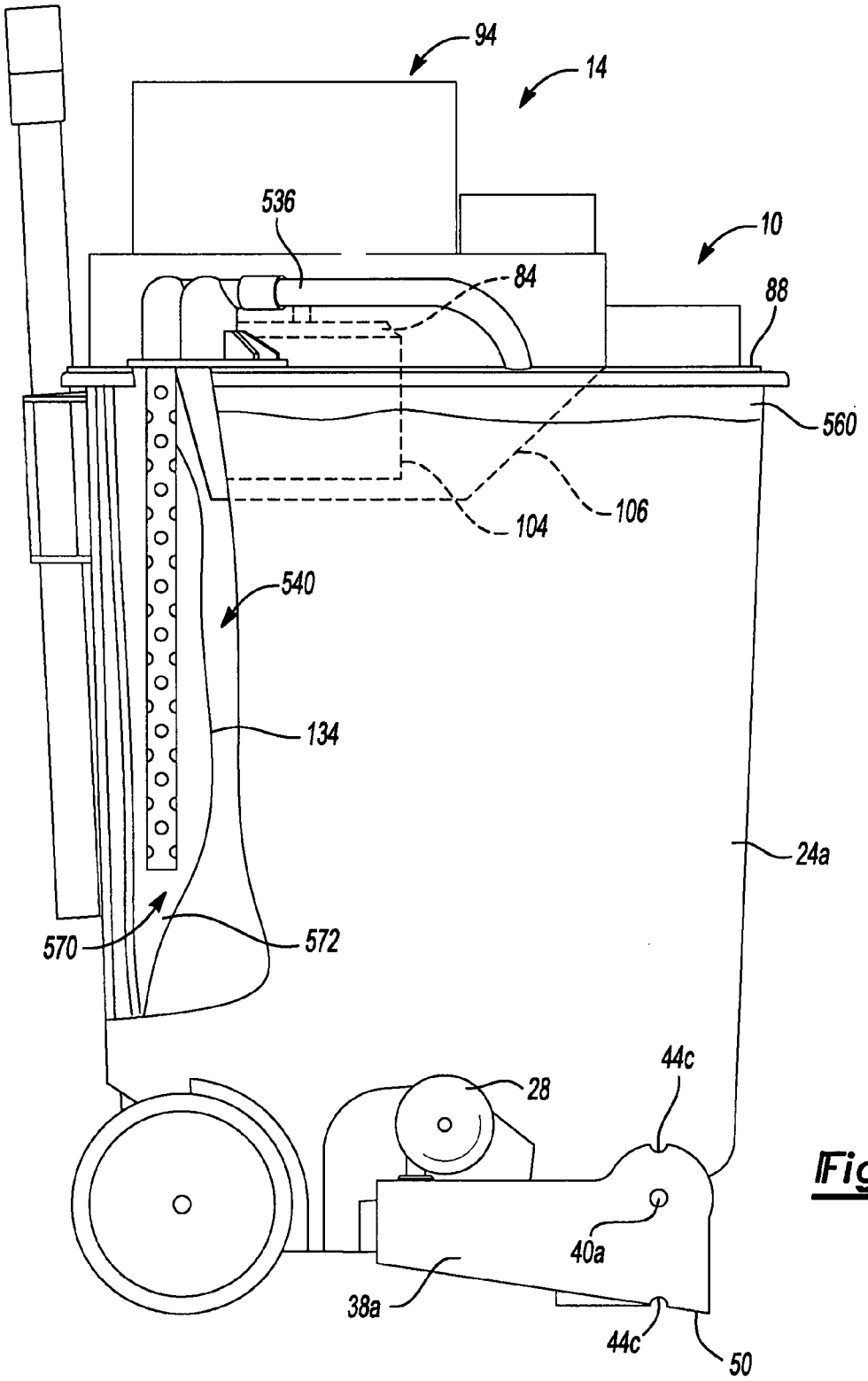
FIG. 5 is a side elevation view of the utility vacuum of FIG. 4 with the legs in a retracted position.
Figure 14:
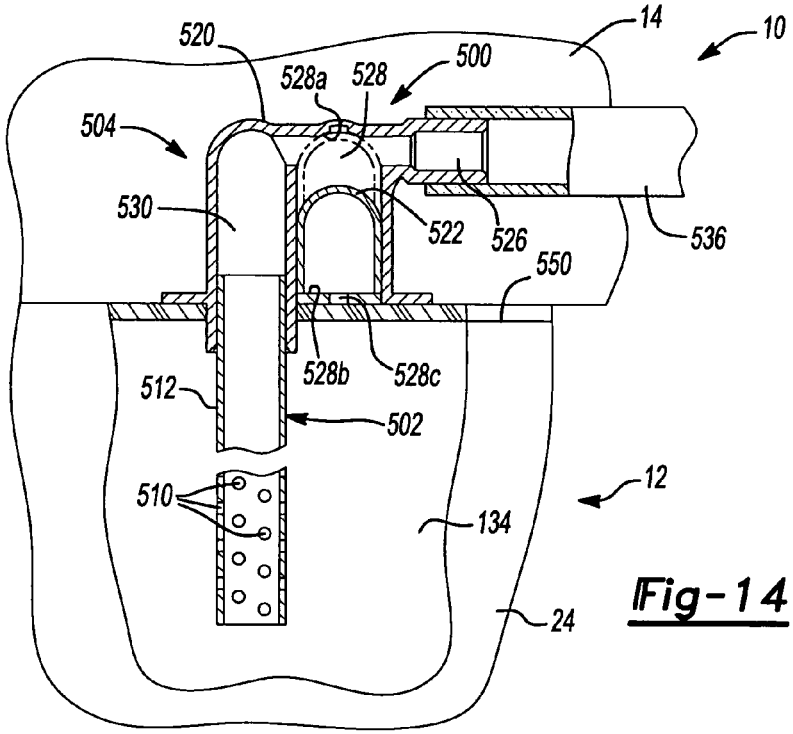
FIG. 14 is a sectional view of a portion of the utility vacuum of FIG. 4 illustrating the vacuum distribution system in greater detail.

Disposable Bagging

Where the disposable bag 134 is employed, the utility vacuum 10 preferably includes a vacuum distribution system 500, an example of which being illustrated in FIGS. 5 and 14. In the example provided, the vacuum distribution system 500 includes a conduit or manifold 502, which is coupled to or integrally formed with the canister housing 24, and a valve 504, which is configured to be coupled in fluid connection to the manifold 502 and the powerhead assembly 14.

In the example illustrated, the manifold 502 is a relatively small diameter tube that is mounted to the interior surface of the canister housing 24. A plurality of axially spaced apart perforations or holes 510 are formed through the wall 512 of the manifold 502 that permit air to flow therethrough. Those skilled in the art will appreciate that the manifold 502, in its broader aspects, may be constructed somewhat differently and as such, the example provided herein is not intended to be limiting in any way. For example, the manifold 502 may be integrally formed in the canister housing 24 and/or may extend around the perimeter of the canister housing 24. Additionally, a filter media (not shown) may be disposed in or around the manifold 502 or in fluid connection with the manifold 502 to inhibit the transmission of dust and debris into the valve 504.

In the embodiment illustrated, the valve 504 is coupled to the powerhead assembly 14 and includes a valve body 520 and a valve element 522. The valve body 520 includes a flow channel 526 and first and second chambers 528 and 530, respectively. The flow channel 526 extends through the first chamber 528 and intersects the second chamber 530. The open end of the flow channel 526 is coupled in fluid connection (via a hose 536 in the example provided) to the powerhead assembly 14 so as to provide a vacuum source. In this regard, the hose 536 may be positioned anywhere that exposes the flow channel 526 to air having an absolute pressure that is less than the absolute pressure of the air in the dirt collecting side 540 of the disposable bag 134 when the utility vacuum 10 is operating. In the example provided, the hose 536 is coupled to the powerhead assembly 14 at a point between the prefilter 106 and the primary filter 104. Alternatively, the hose 536 may be coupled to the powerhead assembly 14 at a point after the primary filter 104 and before the fan 84.

The first chamber 528 is generally vertically oriented and defines a closed upper surface 528*a* and a lower surface 528*b* having a vent aperture 528*c* formed therethrough. The valve body 520 is positioned on the powerhead assembly 14 such that the vent aperture 528*c* is positioned vertically in-line with a top edge 550 of the canister housing 24. In the example illustrated, the second chamber 530 is generally parallel to the first chamber 528 and is coupled in fluid connection with the manifold 502 when the powerhead assembly 14 is coupled to the canister assembly 12 (i.e., the manifold 502 is received into the second chamber 530 when the powerhead assembly 14 is secured to the canister assembly 12).

The valve element 522 is disposed in the first chamber 528 and is movable between a first position, wherein the valve element 522 does not substantially block the flow channel 526, and a second position, wherein the valve element 522 at least significantly blocks the flow channel 526. The weight of the valve element 522 causes the valve element 522 to be normally positioned in the first position.

As mentioned above, the valve body 520 is coupled in fluid connection to the powerhead assembly 14 in a manner that exposes the interior of the valve body 520 to relatively lower pressure air than the air in the canister housing 24 where the dust and debris are being collected when the utility vacuum 10 is operated. Accordingly, the pressure differential tends to cause air to flow through the flow channel 526 toward the powerhead assembly 14.

If a disposable bag 134 is not employed, the vent aperture 528*c* is open to the atmosphere, since the powerhead assembly 14 is not perfectly sealed against the top edge 550 of the canister housing 24, and the pressure differential exerts an upwardly directed force onto the valve element 522 that tends to move the valve element 522 upwardly in the first chamber 528 into the second position. In this position, the valve element inhibits the flow of air through the valve body 520.

When disposable bagging is desired, the disposable bag 134 is installed to the canister housing 24 such that the open end 560 of the disposable bag 134 overhangs the canister housing 24. Installation of the powerhead assembly 14 to the canister assembly 12 clamps the disposable bag 134 between the housing 80 and the top edge 550 of the canister housing 24. The portion of the disposable bag 134 that overhangs the canister housing 24 adjacent the vent aperture 528*c* forms somewhat of a "seal" that at least partially suppresses the infiltration of air into the first chamber 528 via the vent aperture 528*c*.

This "seal" prevents air from being readily drawn from the atmosphere into the first chamber 528 when the utility vacuum 10 is operated, which in turn tends to inhibit upward movement of the valve element 522 in the first chamber 528 so that the valve element 522 is not maintained in the second position. With the valve element 522 not being maintained in the second position, air is drawn from the space 570 between the disposable bag 134 and the interior surface 572 of the canister housing 24, through the manifold 502 and valve body 520. Due to the above-noted pressure differential, air is evacuated from the space 570 between the disposable bag 134 and the canister housing 24 via the manifold 502 so that air pressure forces the portion of the disposable bag 134 within canister housing 24 against the interior surface of the canister housing 24.

Accessory Apron

Figure 15:
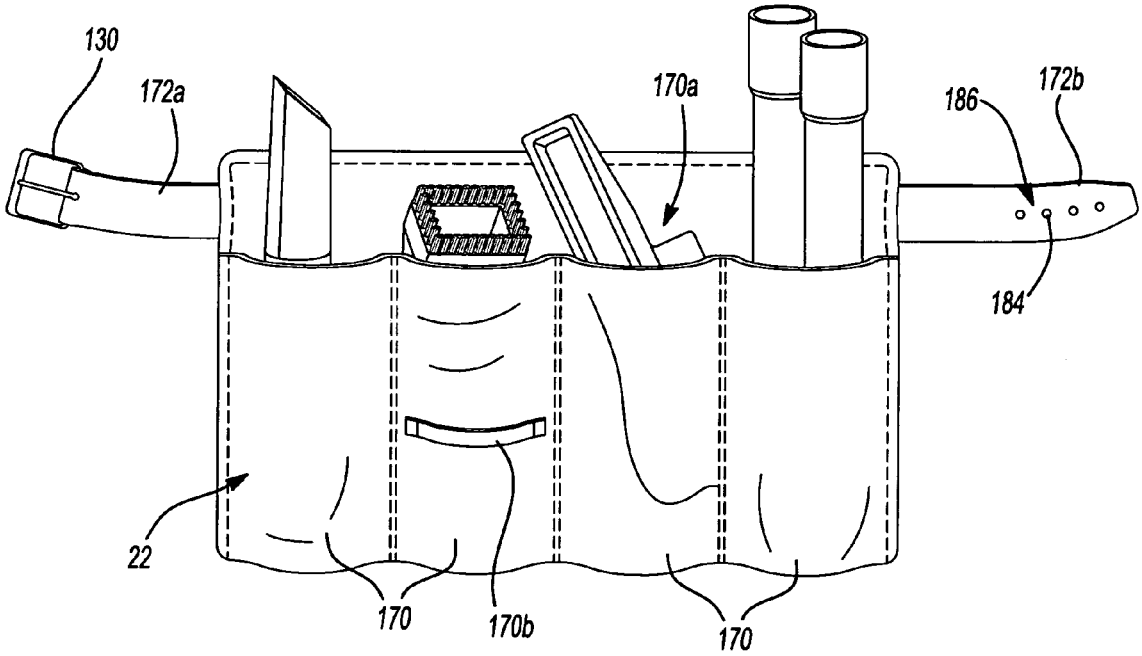
FIG. 15 is a front elevation view of a portion of the utility vacuum of FIG. 1 illustrating the accessory apron in greater detail.

Returning to FIG. 1 and with additional reference to FIG. 15, the accessory apron 22 is formed from a suitable plastic (e.g., PVC), fabric, or leather material and includes a plurality of holders 170, which are sized to receive and removably store various tools and accessories 20, an optional strap 172, and an optional fastener 174 that permits the ends 172*a*, 172*b* of the strap 172 to be coupled to the canister assembly 12 and/or the powerhead assembly 14. The holders 170 may be of any suitable configuration and may include, for example, pouches 170*a* that are closed on three sides (i.e., open only at their top), and/or one or more elastic bands 170*b* that frictionally engage a tool or accessory inserted thereto.

The strap 172, which may comprise a single strap or two strap portions, extends from the opposite sides of the holders 170. The fastener 174 may include VELCRO®, one or more hooks, one or more snaps or any other type of fastener that permits the releasable attachment of the strap 172 to another portion of the strap 172 or the holders 170. In the example provided, the fastener 174 is illustrated to be a conventional tool-belt-type fastener having a D-shaped ring 180, which is coupled to a first end 172*a* of the strap 172, and a peg 182 that is pivotably coupled to the D-shaped ring 180 and sized to engage one hole (e.g., hole 184) in a series 186 of holes that are formed in the opposite end 172*b* of the strap 172. The holes in the series 186 are conventionally spaced apart from one another by a predetermined distance along the length of the opposite end 172*b* of the strap 172, thus permitting the accessory apron 22 to be adjusted to fit about the canister assembly 12, for example, or about the waist of the user of the utility vacuum 10. This configuration of the accessory apron 22 permits it to be worn about the user's waist so that the tools and accessories 20 contained therein are handy when the utility vacuum 10 is being used or to be draped about the perimeter of the utility vacuum 10 so that they are close in proximity to the utility vacuum 10 whether the utility vacuum 10 is being stored or in use.

Alternately, the fastener 174 may only permit the ends 172*a*, 172*b* of the strap 172 to be coupled (permanently or removably) to the utility vacuum 10. Also alternatively, the fastener 174 may be omitted by coupling the ends 172*a*, 172*b* of the strap 172 to one another (or to the holders 170) or by forming the strap 172 in an endless manner. In this latter example, the accessory apron 22 may be installed over the powerhead assembly 14 and draped onto the utility vacuum 10.

Power Dust Pan Attachment

Figure 16:
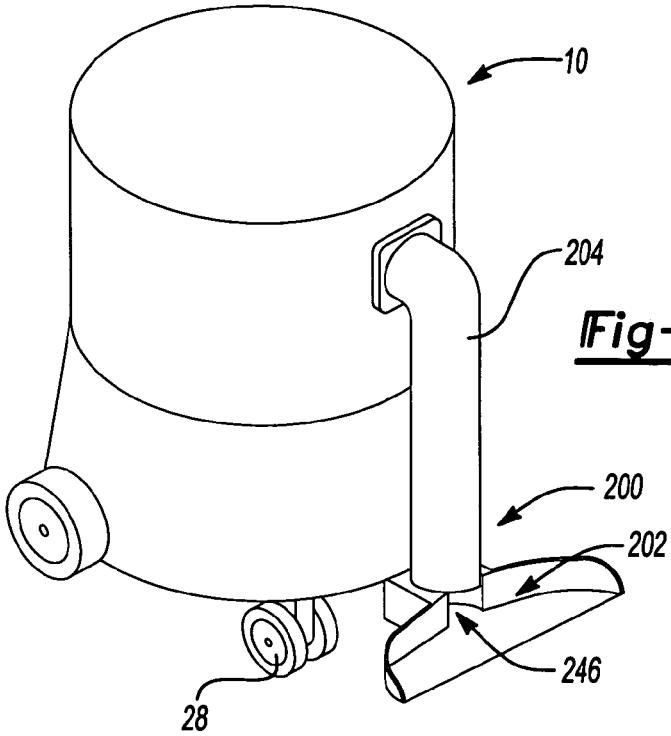
FIG. 16 is a perspective view illustrating the utility vacuum of FIG. 1 in operative association with a power dust pan attachment constructed in accordance with the teachings of the present invention.
Figure 17:
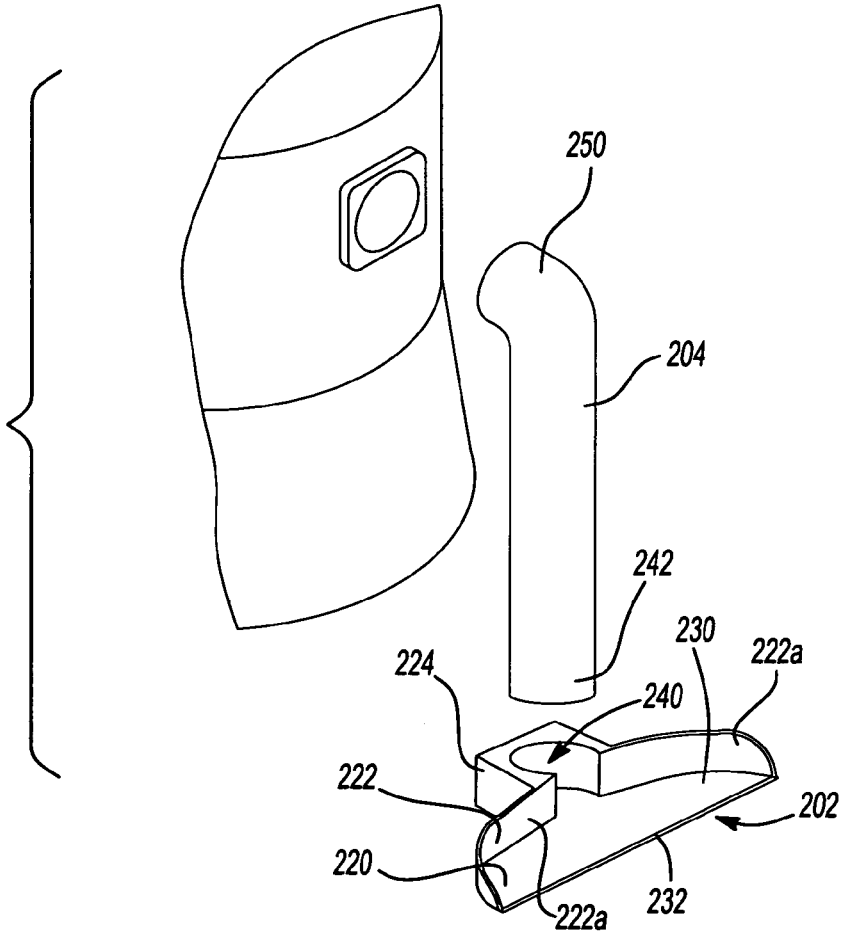
FIG. 17 is an exploded perspective view of the power dust pan attachment of FIG. 16.

In FIGS. 16 and 17, an optional power dust pan attachment 200 constructed in accordance with the teachings of another aspect of the present invention is illustrated in operative association with the utility vacuum 10. In the example provided, the power dust pan attachment 200 includes a dust pan 202 and an interconnecting conduit 204. The dust pan 202 includes a bottom wall 220, an end wall 222 and an elevating foot 224. The bottom wall 220 includes a generally flat portion 230 and a tapered leading edge 232 that is coupled to or integrally formed with the flat portion 230 and which is configured to permit dust and debris to be easily swept onto the flat portion 230. In the example provided, the end wall 222 includes opposite portions 222*a* that are mirror images of one another. Each portion 222*a* of the end wall 222 is coupled to and wraps rearwardly about the bottom wall 220 toward the other portion 222*a* of the end wall 222. The portions 222*a* of the end wall 222 interconnect in a manner that defines a combination port 240.

The combination port 240 is bounded on its lower side by the bottom wall 220 and is open on its top side to permit the interconnecting conduit 204 to be inserted thereto. More specifically, the combination port 240 is sized to receive a tapered male end 242 of the interconnecting conduit 204 in a manner that is commonly employed in the art to couple various hoses and tubular extensions to one another and/or various vacuum accessories. When engaged to the combination port 240, the tapered male end 242 of the interconnecting conduit 204 is spaced apart from the bottom wall 220 to define therebetween a debris entry aperture 246.

Figure 18:
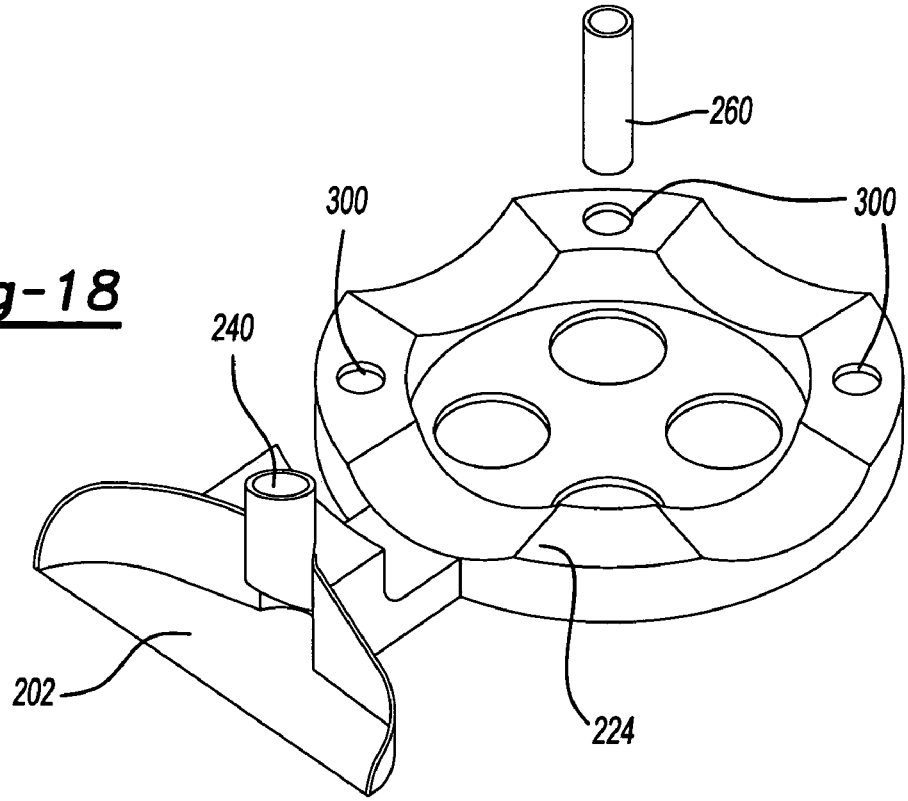
FIG. 18 is a perspective view of an alternately constructed dust pan.

The elevating foot 224 is unitarily formed with the dust pan 202 in the example provided, extending downwardly from the bottom side of the bottom wall 220. In its simplest form, the elevating foot 224 is a wedge that is employed to tilt the canister housing 24 to elevate the second set of wheels 28 off the ground and position the leading edge 232 of the dust pan 202 against the ground. Alternatively, the elevating foot 224 may be sized somewhat larger as shown in FIG. 18 to permit all or a portion of the canister housing 24 to be positioned in a predetermined orientation and/or to include apertures 300 that are sized to receive therein various tools and accessories.

Figure 19:
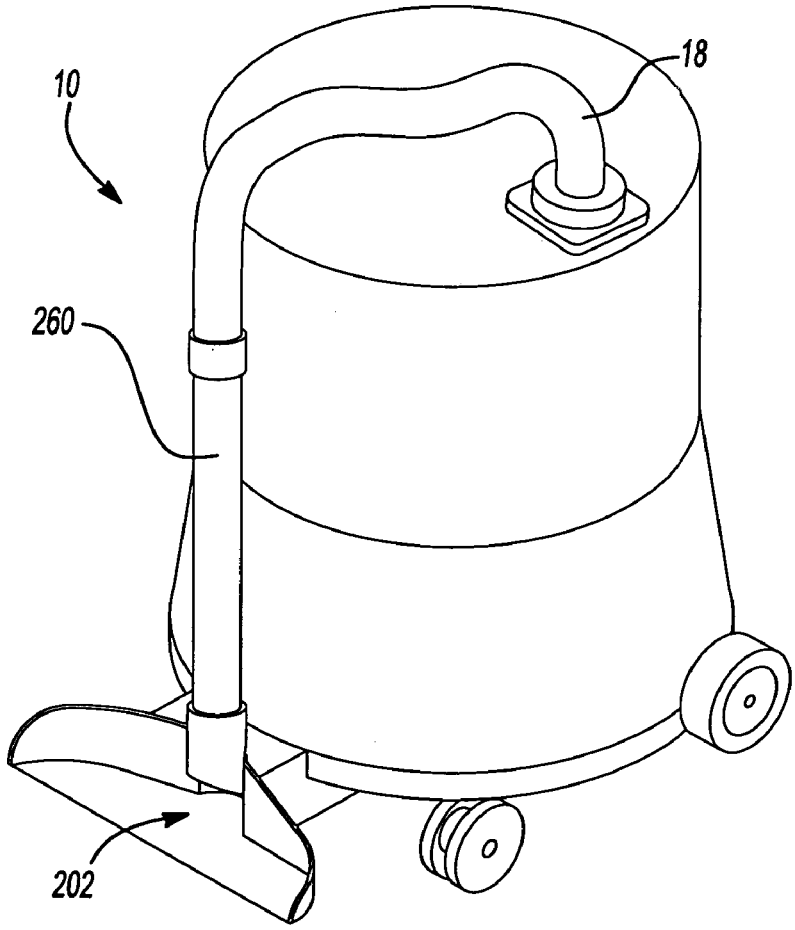
FIG. 19 is a perspective view of an alternately constructed power dust pan attachment.

Returning to FIGS. 16 and 17, the interconnecting conduit 204 includes an end 250 opposite the tapered male end 242 that is sized to engage the inlet port 90 to thereby couple the dust pan 202 in fluid connection to the utility vacuum 10. Accordingly, dust and debris swept into or otherwise deposited into the dust pan 202 may be drawn through the debris entry aperture 246 and into central cavity of the utility vacuum 10 via the interconnecting conduit 204. Those skilled in the art will appreciate that although the interconnecting conduit 204 is illustrated as a rigid tube, a conventional hose assembly 18, which is illustrated in FIG. 19, with or without a conventional tubular extension 260 may alternatively be employed to couple the dust pan 202 in fluid connection to the utility vacuum 10. The rigid tube of FIGS. 16 and 17 permits the combination port 240 and interconnecting conduit 204 to be sized as large as is practicable to increase the capability of the power dust pan attachment 200 to remove dirt and debris from the dust pan 202. The alternative approach illustrated in FIG. 19 (i.e., hose assembly 18 with or without a tubular extension 260) reduces the cost and improves the convenience of the power dust pan attachment 200 by employing existing tools and accessories.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and appended claims.

What is claimed is:

1. A vacuum comprising:

a container-shaped housing;

a powerhead assembly having a powerhead housing, a motor and a fan, the powerhead housing closing an open end of the container shaped housing and including an intake opening and an outlet opening, the fan being housed in the powerhead housing and being operable for drawing a flow of debris laden air through the inlet port and into the container-shaped housing, the fan exhausting an fan of air to the outlet opening;

a filter coupled to the powerhead assembly between the intake opening and the fan;

a valve for selectively closing an intake opening of the powerhead housing; and a vacuum distribution system with a conduit, the conduit being disposed at least partially in the container-shaped housing and being coupled in fluid connection to the powerhead housing at a location downstream of the filter and upstream of the exhaust flow.

2. A vacuum comprising:

a container-shaped housing;

a powerhead assembly having a powerhead housing, a motor and a fan, the powerhead housing closing an open end of the container shaped housing and including an intake opening, the fan being housed in the powerhead housing and being operable for drawing a flow of debris laden air through the inlet port and into the container-shaped housing;

a filter coupled to the powerhead assembly between the intake opening and the fan;

a valve for selectively closing an intake opening of the powerhead housing; and a vacuum distribution system with a conduit, the conduit being disposed at least partially in the container-shaped housing and being coupled in fluid connection to the powerhead housing at a location downstream of the filter;

wherein the vacuum distribution system includes a distribution valve for selectively inhibiting a flow of air through the conduit.

3. The vacuum of claim 2, wherein the distribution valve includes a valve body and a valve element, the valve body defining a chamber in which the valve element is movably housed, the chamber including a vent.

4. The vacuum of claim 3, wherein the vent is disposed in-line with a top edge of the container-shaped housing.

5. The vacuum of claim 4, further comprising a disposable bag disposed in the container-shaped housing and extending between the top edge and the vent.

6. The vacuum of claim 2, wherein the distribution valve is configured to automatically inhibit a flow of air through the conduit if a disposable bag is not installed to the container-shaped housing in a predetermined manner.

7. The vacuum of claim 6, wherein the chamber includes a vent and wherein the disposable bag at least partially seals the vent when the disposable bag is installed to the container-shaped housing in the predetermined manner.

8. A vacuum comprising:

a container-shaped housing;

a powerhead assembly having a powerhead housing, a motor and a fan, the powerhead housing closing an open end of the container shaped housing and including an intake opening, the fan being housed in the powerhead housing and being operable for drawing a flow of debris laden air through the inlet port and into the container-shaped housing;

a filter coupled to the powerhead assembly between the intake opening and the fan;

a valve for selectively closing an intake opening of the powerhead housing; and a vacuum distribution system with a conduit, the conduit being disposed at least partially in the container-shaped housing and being coupled in fluid connection to the powerhead housing at a location downstream of the filter;

wherein the conduit includes a plurality of axially spaced apertures.

9. A vacuum comprising:

a container-shaped housing;

a powerhead assembly having a powerhead housing, a motor and a fan, the powerhead housing closing an open end of the container shaped housing and including an intake opening, the fan being housed in the powerhead housing and being operable for drawing a flow of debris laden air through the inlet port and into the container-shaped housing;

a filter coupled to the powerhead assembly between the intake opening and the fan;

a valve for selectively closing an intake opening of the powerhead housing; and a vacuum distribution system with a conduit, the conduit being disposed at least partially in the container-shaped housing and being coupled in fluid connection to the powerhead housing at a location downstream of the filter;

wherein the conduit is oriented about a generally vertical axis.

10. A method comprising:

providing a vacuum having a container-shaped housing, a powerhead assembly, a filter and a vacuum distribution system, the powerhead assembly including a lid for closing an open end of the container-shaped housing, a fan housing, which is coupled to at least one of the container-shaped housing and the lid, and a fan that is at least partially housed by the fan housing and operable for drawing a flow of air through an intake opening, the filter being disposed between the fan and the intake opening, the vacuum distribution system having an inlet that is disposed in an interior area of the container-shaped housing;

placing a disposable bag in the interior area of the container-shaped housing;

securing the lid to the container shaped housing such that a portion of the disposable bag is disposed between at least two of the container-shaped housing, the fan housing and the lid; and drawing air through the inlet to at least partially evacuate a volume between the container-shaped housing and the disposable bag;

wherein the vacuum distribution system further includes a valve with a valve housing that is fluid communication with the inlet and wherein the disposable bag at least partially closes a vent in the valve housing.

11. The method of claim 10, further comprising:

removing the disposable bag from the container-shaped housing; and moving a valve element in the valve housing to inhibit fluid communication from the inlet through the valve housing.

12. The method of claim 11, wherein the valve element moves in response to a pressure differential.

* * * * *